US007641410B2

(12) United States Patent
Frazell

(10) Patent No.: US 7,641,410 B2
(45) Date of Patent: Jan. 5, 2010

(54) TOOTHBRUSH WITH DENTIFRICE DISPENSER

(76) Inventor: Dale M. Frazell, 15205 N. McFarland Creek Rd., Boise, ID (US) 83714

( * ) Notice: Subject to any disclaimer, the term of this patent is extended or adjusted under 35 U.S.C. 154(b) by 7 days.

(21) Appl. No.: 11/424,652

(22) Filed: Jun. 16, 2006

(65) Prior Publication Data

US 2007/0292198 A1 Dec. 20, 2007

(51) Int. Cl.
*B43M 11/06* (2006.01)

(52) U.S. Cl. ..... 401/184; 401/183; 401/278

(58) Field of Classification Search ..... 401/132–135, 401/268, 175, 183–186, 269, 270, 278; 15/167.1, 15/110, 188

See application file for complete search history.

(56) References Cited

U.S. PATENT DOCUMENTS 1,753,290 A * 4/1930 Graves ..... 401/132
3,353,898 A * 11/1967 Lamberti ..... 401/132
3,589,823 A * 6/1971 Hendrickson ..... 401/132
3,989,309 A 11/1976 Thorner
4,171,169 A 10/1979 Williams
4,417,826 A 11/1983 Floros
4,588,089 A * 5/1986 Yanz et al. ..... 401/132
4,674,904 A 6/1987 Buck
4,695,177 A 9/1987 Kuo
4,764,047 A 8/1988 Johnston et al.
4,787,765 A 11/1988 Kuo
4,893,957 A 1/1990 Byriel
4,902,154 A * 2/1990 Valenza ..... 401/132
4,998,836 A 3/1991 Scripnick
5,062,728 A 11/1991 Kuo
5,094,558 A 3/1992 Chu
5,169,252 A 12/1992 Chappell
5,211,494 A 5/1993 Baijnath
5,239,712 A 8/1993 Kinder
5,271,682 A 12/1993 Realdon
5,309,590 A 5/1994 Giuliani et al.
5,345,640 A 9/1994 Goss
5,346,324 A 9/1994 Kuo
5,366,310 A * 11/1994 Armelles Flors ..... 401/132
5,403,105 A 4/1995 Jameson
5,425,589 A 6/1995 Griffin et al.
5,439,014 A 8/1995 Moussa
5,476,333 A * 12/1995 Matthews ..... 401/132
5,476,384 A 12/1995 Giuliani et al.
5,561,869 A 10/1996 Sarel
5,649,334 A 7/1997 Henriquez et al.
5,649,502 A 7/1997 Frank
5,709,490 A 1/1998 Dyas
5,724,695 A 3/1998 Galizia
5,813,078 A 9/1998 Hogan, Sr.
5,909,977 A 6/1999 Kuo
5,913,632 A 6/1999 Persad (Continued)

*Primary Examiner*—David J Walczak
(74) *Attorney, Agent, or Firm*—Robert L. Shaver; Dykas, Shaver & Nipper, LLP

(57) ABSTRACT

A cleaning brush with a dispenser for cleaning product. The cleaning product is stored in a cavity, and is dispensed by pressing on a flexible membrane on one side of the cavity. When thus depressed, the cleaning product is extruded through holes in the head into the region of the bases of bristles on the front side of the brush. The toothbrush is ergonomically shaped in a concave spoon like shape to fit a user's hand more comfortably. The brush may include a cover which has a general appearance of a fountain pen to facilitate an in obtrusive carrying of the brush.

5 Claims, 7 Drawing Sheets

U.S. PATENT DOCUMENTS 5,915,868 A 6/1999 Frazell
5,988,911 A 11/1999 Browne, Jr. et al.
6,009,886 A 1/2000 Labranche et al.
6,035,477 A 3/2000 Robert
6,095,709 A 8/2000 Armer et al.
6,142,694 A 11/2000 Rivlin et al.
6,151,728 A 11/2000 Wright et al.
6,164,496 A 12/2000 Gregory
6,170,108 B1 1/2001 Knight
6,210,057 B1 4/2001 Yannaci et al.
6,241,412 B1 6/2001 Spies et al.
6,280,111 B1 8/2001 Armer et al.
6,287,037 B1 9/2001 Hay
6,402,410 B1 6/2002 Hall et al.
6,413,002 B1 7/2002 Delaine, Jr.
6,425,701 B1 7/2002 Jacobs
6,439,790 B1 8/2002 Kay
6,575,203 B2 6/2003 Hall et al.
6,591,455 B2 * 7/2003 Heavenor ..... 16/430
6,623,201 B2 9/2003 Brumlik
6,644,878 B2 11/2003 Hall et al.
6,687,924 B2 2/2004 Wright et al.
6,729,789 B2 5/2004 Gordon
6,735,803 B2 5/2004 Kuo
6,748,619 B2 6/2004 Quach
6,749,135 B2 6/2004 Groblebe et al.
6,808,331 B2 10/2004 Hall et al.
6,813,798 B2 11/2004 Moga
6,902,337 B1 6/2005 Kuo
6,996,861 B1 2/2006 Clark, Jr.
7,004,662 B1 2/2006 Gordon
7,040,830 B2 5/2006 Kliegman et al.
7,070,354 B1 7/2006 Gutierrez-Caro
2002/0081138 A1 6/2002 Hall et al.
2002/0090252 A1 7/2002 Hall et al.
2002/0114658 A1 8/2002 Allen et al.
2003/0126678 A1 7/2003 Wright et al.
2003/0198503 A1 10/2003 Gordon
2003/0221270 A1 12/2003 Kuo
2003/0230645 A1 12/2003 Groblebe et al.
2004/0022576 A1 2/2004 Hoyle et al.
2004/0062591 A1 4/2004 Hall et al.
2004/0143918 A1 7/2004 Blackman et al.
2004/0265043 A1 12/2004 Palme
2005/0147458 A1 7/2005 Hohlbein
2005/0211270 A1 9/2005 Wheelwright

* cited by examiner

TOOTHBRUSH WITH DENTIFRICE DISPENSER

BACKGROUND OF THE INVENTION

Field of the Invention

The present invention relates to a cleaning brush, and more specifically, the invention provides a system within a toothbrush for delivery of a self-contained supply of a cleaning product such as dentifrice.

SUMMARY OF THE INVENTION

The invention can be configured as a number of different kinds of brushes, including scrub brushes, pet cleaning brushes, and human toothbrushes. The present invention operates to provide a portable toothbrush or other brush with a quantity of dentifrice which may or may not be refillable. The invention is improved over related art in its innovative design, in its ergonomic facility in both gripping the handle and moving the soft, rounded head through the mouth, and in its outward appearance.

The invention is a brush with a built in quantity of cleaning product and a system for dispensing the cleaning product. This description will describe the brush as a toothbrush, but it is to be understood that the invention could be applied to a number of different brushes including scrub brushes or brushes for cleaning a variety of objects.

The brush of the invention has a handle, having a longitudinal axis, with a head attached to the handle. A number of bristles are attached to the front surface of the head by the bristled bases. The bristles extend generally perpendicular from the front surface of the head. A flexible compartment cover is attached to the back surface of the head opposite the position of the bristles.

The flexible compartment cover can be attached to the back surface of the head in a number of ways including a friction fit with a mounting structure on the back surface of the head. The flexible compartment cover is configured to contain a quantity of cleaning product and to dispense the cleaning product into the region at the base of the bristles when the flexible compartment cover is depressed. Located in the head is at least one hole which extends from the back surface under the flexible compartment cover to the front surface among the base of the bristles. The flexible compartment cover is made of soft material which is configured to flex concavely inward when pressed by a users thumb or finger. When thus compressed, the cleaning product is pushed through the hole or holes of the head and is deposited among the bristles on the head.

The cleaning brush can further contain an interior space in the head of the brush, which is open on one side and configured to fit with and be sealed by the flexible compartment cover. The use of the interior space allows the cleaning products such as dentifrice, soap or detergent to be placed in the interior space and sealed from the environment by use of the flexible compartment cover. The flexible compartment cover can be fixedly and permanently attached to the head during manufacture, although it would first be manufactured as two pieces which are later joined. In such configuration, the brush of the invention would not be refillable, and would come with a certain quantity of cleaning product, and would be disposable after the cleaning product is used.

The cleaning brush of the invention can also be configured so that the flexible compartment cover is removably attached to the head, so that the cleaning product may be replenished when it is used, and the flexible compartment cover can be open or closed as part of the refilling process.

The cleaning brush of the invention typically has the flexible compartment cover in the form of a rounded outer surface for increased comfort in the users mouth. In the case of a cleaning brush in which the flexible compartment cover is fixedly attached to the head during the manufacture, the flexible compartment cover includes a sonic well seam. The cleaning brush of the invention has at least one hole through the head, but typically a number of holes are available to dispense the cleaning product.

The cleaning brush of the invention can further include a finger ridge adjacent to the region of bristle bases for assisting the user in squeezing the flexible compartment cover without touching the bristles with the finger. When cleaning product is injected into the bristles, what would typically happen is the user would press down on the outside surface of the flexible compartment cover and basically press his thumb towards his finger, with the thumb on the back side of the head, and the finger on the front side of the head. By having a finger ridge on the head adjacent to the bristles, the finger ridge would help the user to press the cleaning product into the bristles without touching the bristles with his finger or knuckle of his finger.

The cleaning brush can further include a handle, having a longitudinal axis, which is generally spoon shaped which adds to the ergonomic appearance and function of the brush. In versions which include a spoon shaped handle, the handle has a concave front surface, and a convex back surface.

Inside the invention are important mechanical innovations. As mentioned, the head behind the bristles is constructed of soft, flex-memory plastic which can be compressed to release the dentifrice. Upon release, the flex-memory plastic returns to its original shape but remains soft and comfortable in the mouth during the brushing process.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
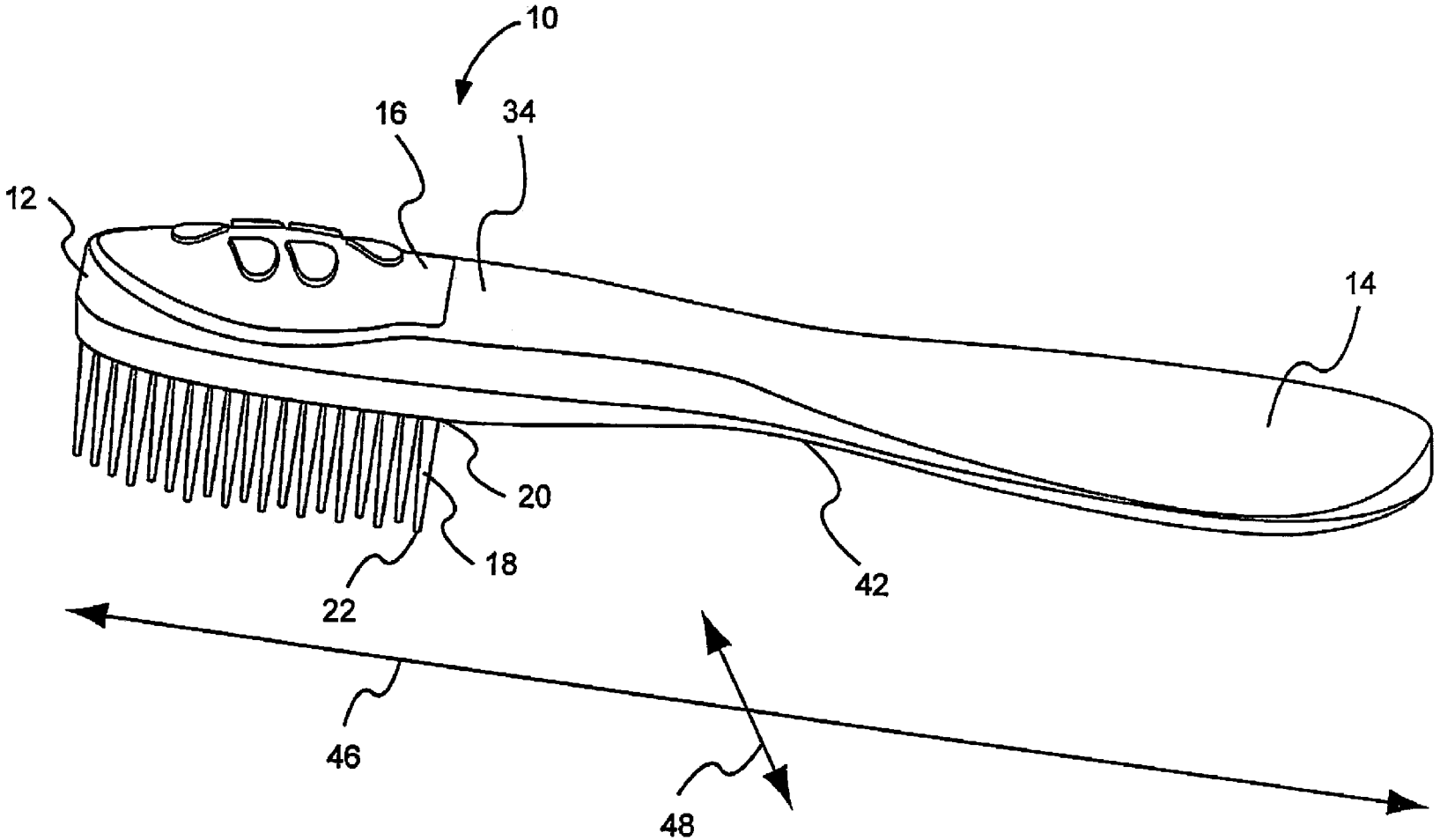
FIG. 1 is a prospective view of the cleaning brush of the invention.

While the invention is susceptible of various modifications and alternative constructions, certain illustrated embodiments thereof have been shown in the drawings and will be described below in detail. The basic elements of the toothbrush include a head 12, a handle 14, a flexible compartment cover 16, bristles 18, and a neck 42 which connects the head to the handle of the brush.

The head of the brush can optionally include an interior cavity which is shown in the figures. The interior cavity is enclosed, it is open to the back, and is covered by a flexible compartment cover which is made of a flexible plastic or rubber device. The cleaning product is enclosed within the space between the flexible compartment cover and the back surface of the head of the brush. The interior space 26 is shown in several of the figures, and is an optional feature which allows more cleaning product to be stored in the head, and which allows the head to have a more narrow profile for ease of use. The flexible compartment cover utilizes a flexible memory material which may be easily depressed but which springs back through its depressed form when pressure is released.

Figure 2:
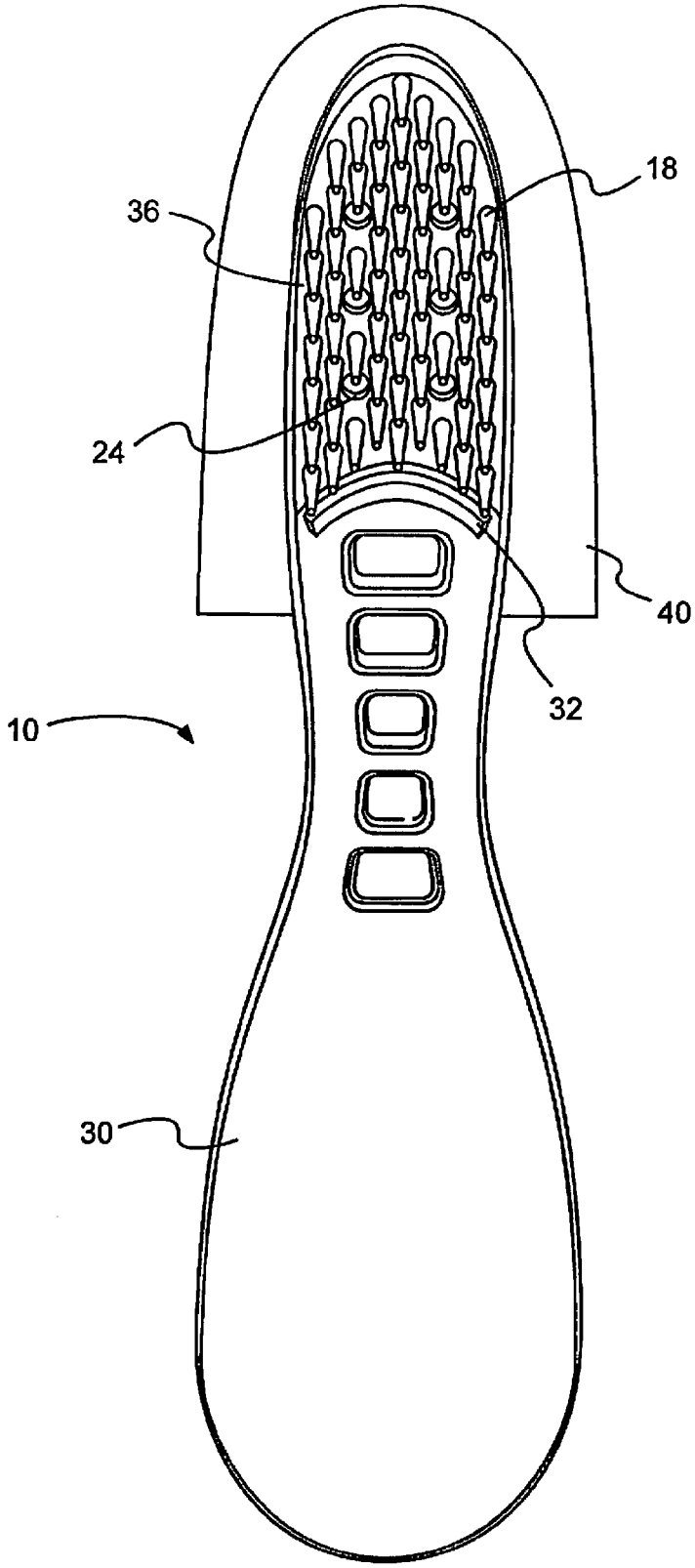
FIG. 2 is a prospective view of the front side of the cleaning brush of the invention.

The flexible compartment cover 16 may be permanently bonded to the back surface of the head 34 during the manufacturing process, in which case the cleaning product would be inserted under the flexible compartment cover. The flexible compartment cover can also be configured to be removable, and thus the brush would be refillable with cleaning product 28. FIG. 1 shows the cleaning brush 10 of the invention with bristles 18 having a base 20 and a tip 22. The neck 42 attaches the head 12 to the handle 14 to the brush. The handle 14 to the brush has a longitudinal axis 46 and a latitudinal axis 48. The flexible compartment cover 16 is shown attached to the back surface 34 of the head. FIG. 2 shows another view of the cleaning brush 10 of the invention, showing the bristles 18, the holes 24, and the front surface 36 of the head. A spoon shaped handle 30 is shown, which is concave on the front surface and convex on the back surface.

Shown in FIG. 2 is a finger ridge 32 which can take the form of a small ridge or detent, or can be formed into a more substantial wall which in the form of a wall can be approximately ¼ the height of the bristles to the full height of the bristles. As shown in FIG. 2 is a sealing cap 40 which is a cover for isolating the head of the brush 10 from contact with the environment. This would prevent particles from contacting the head, the bristles, or the cleaning product of the brush of the invention.

Figure 3:
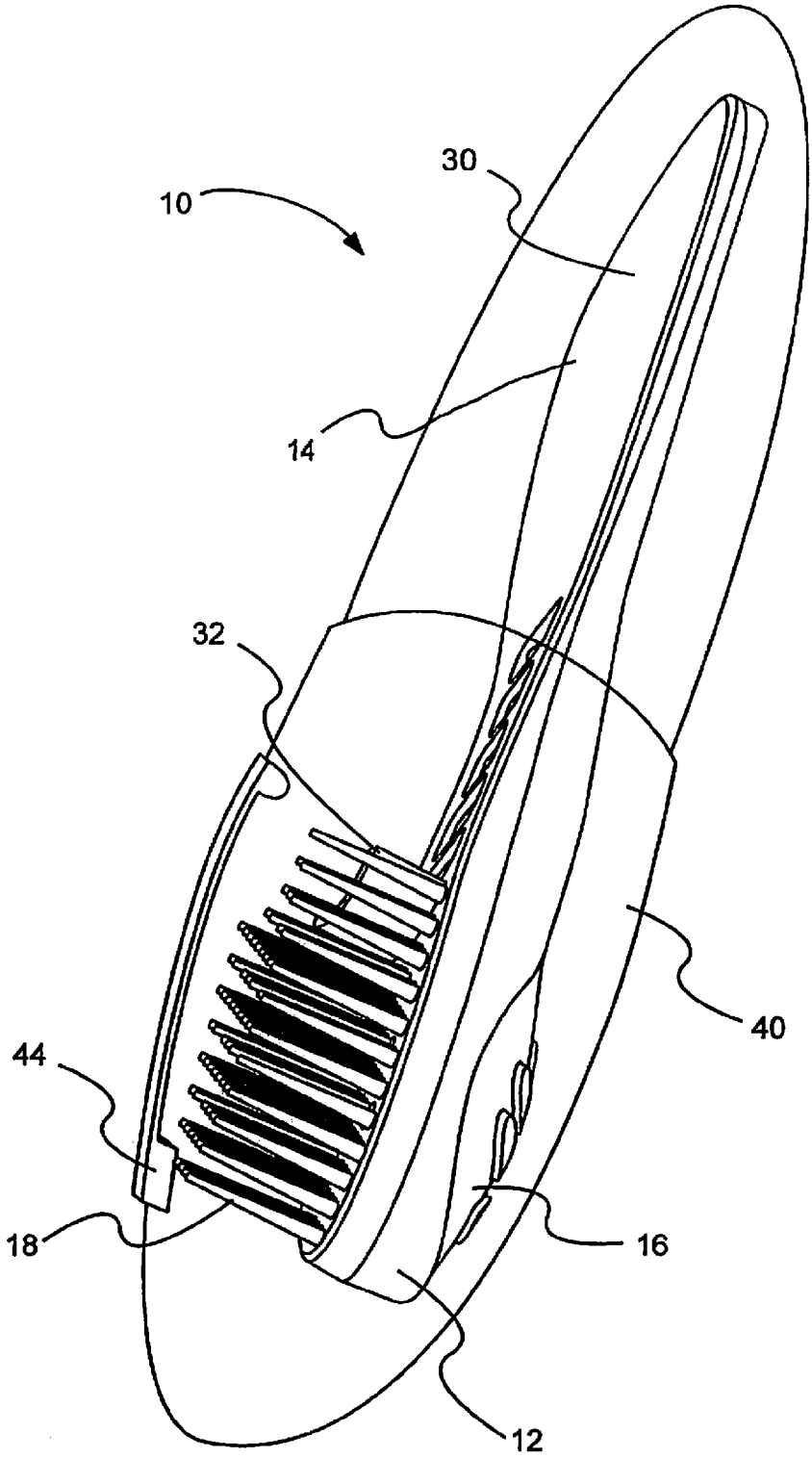
FIG. 3 is prospective view showing the side of the cleaning brush.

FIG. 3 shows an embodiment of the brush in which the sealing cap 40 is generally configured to resemble the exterior shape of a pen which may be carried in a person's pocket, and includes a clip 44 for securing the brush to a users pocket as if it were a pen with a clip. FIG. 3 is another view of the brush of the invention which shows the finger ridge 32 as a substantial wall. The purpose of the finger ridge 32 is to allow the user to press on the flexible compartment cover 16 while the brush is held in up position by a finger adjacent the bristles. Without the finger ridge it is difficult to keep the persons finger from contacting the bristles. Thus the finger ridge allows the user to press his thumb against his finger and squeeze cleaning product into the bristles without touching the side of his finger or the knuckles against the bristles.

Figure 4:
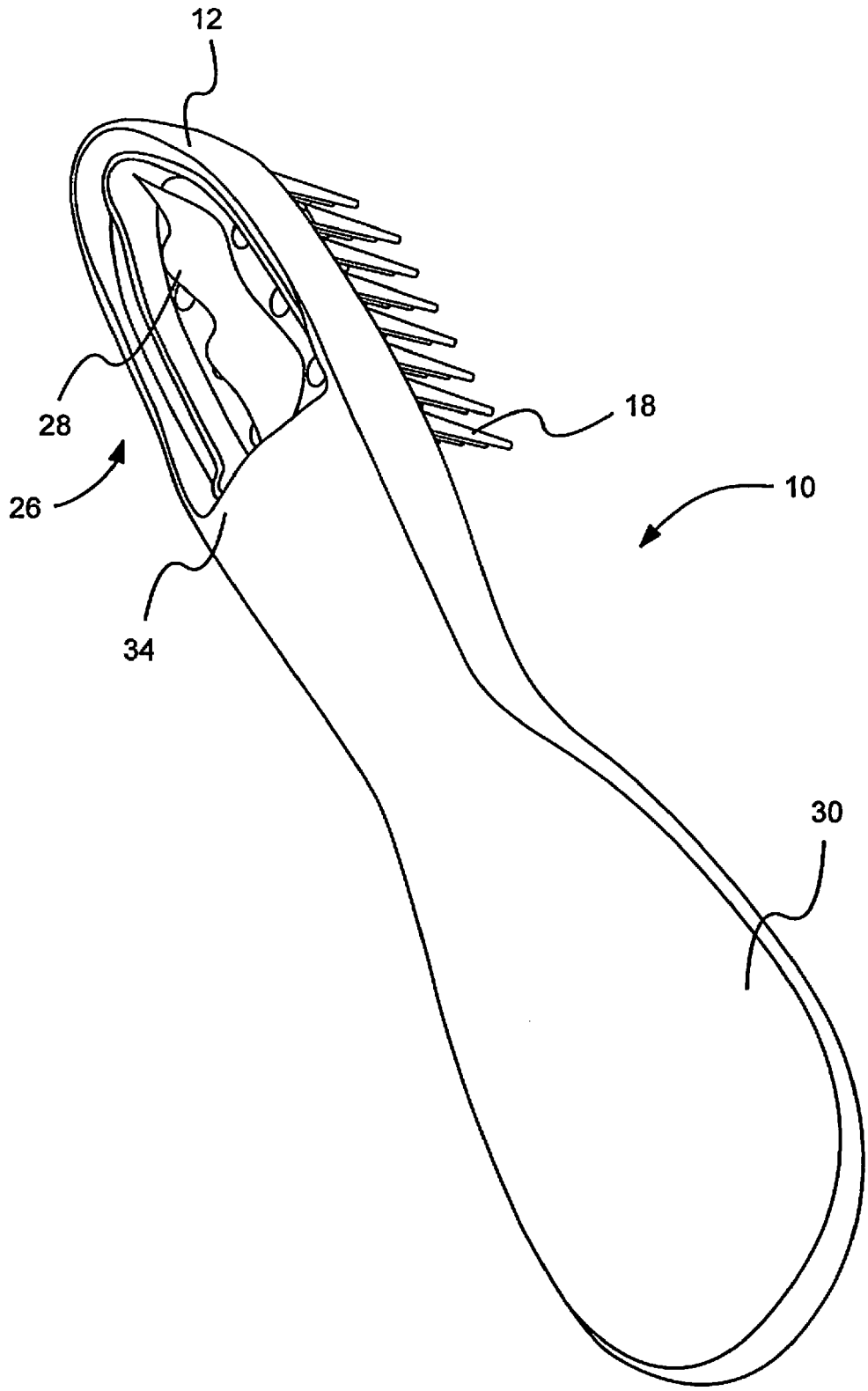
FIG. 4 is a perspective view of the cleaning brush of the invention showing the backside and the interior space of the invention.
Figure 5:
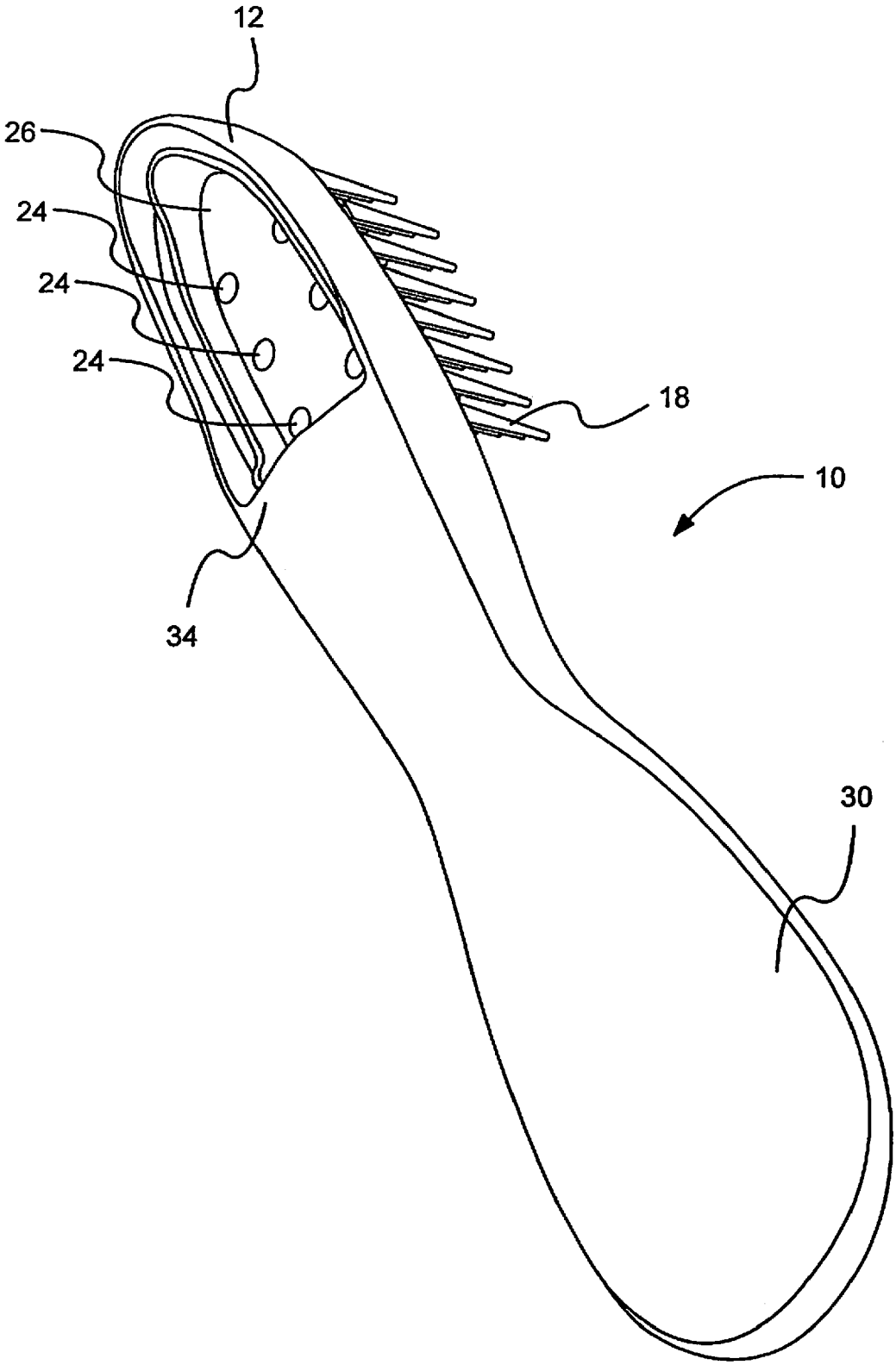
FIG. 5 is a perspective view showing the backside of the invention with the flexible compartment cover removed.

FIG. 4 is another view of the cleaning brush of the invention which shows the interior space 26 with the flexible compartment cover 16 removed. The interior space 26 is a cavity defined in the head 12 in which a cleaning product 28 can be deposited. Such a cleaning product can be dentifrice, soap, detergent, an ammonia based cleaner, baking soda, baking soda paste, an oil based paste, or any number of products which typically might be used with a brush for scrubbing and cleaning an object. Such a cleaning product and brush should be used to apply material to objects for cleaning surfaces of the object or to apply a paste such as leather treatment to objects such as saddles or boots. An oil based or waxed based material can also be applied to the cleaning brush of the invention to apply shoe polish. FIG. 5 is a view of the back surface 34 of the head in which the interior space 26 is shown to contain a number of holes 24 through which cleaning product is pressed into the region of the bristles 18.

Figure 6:
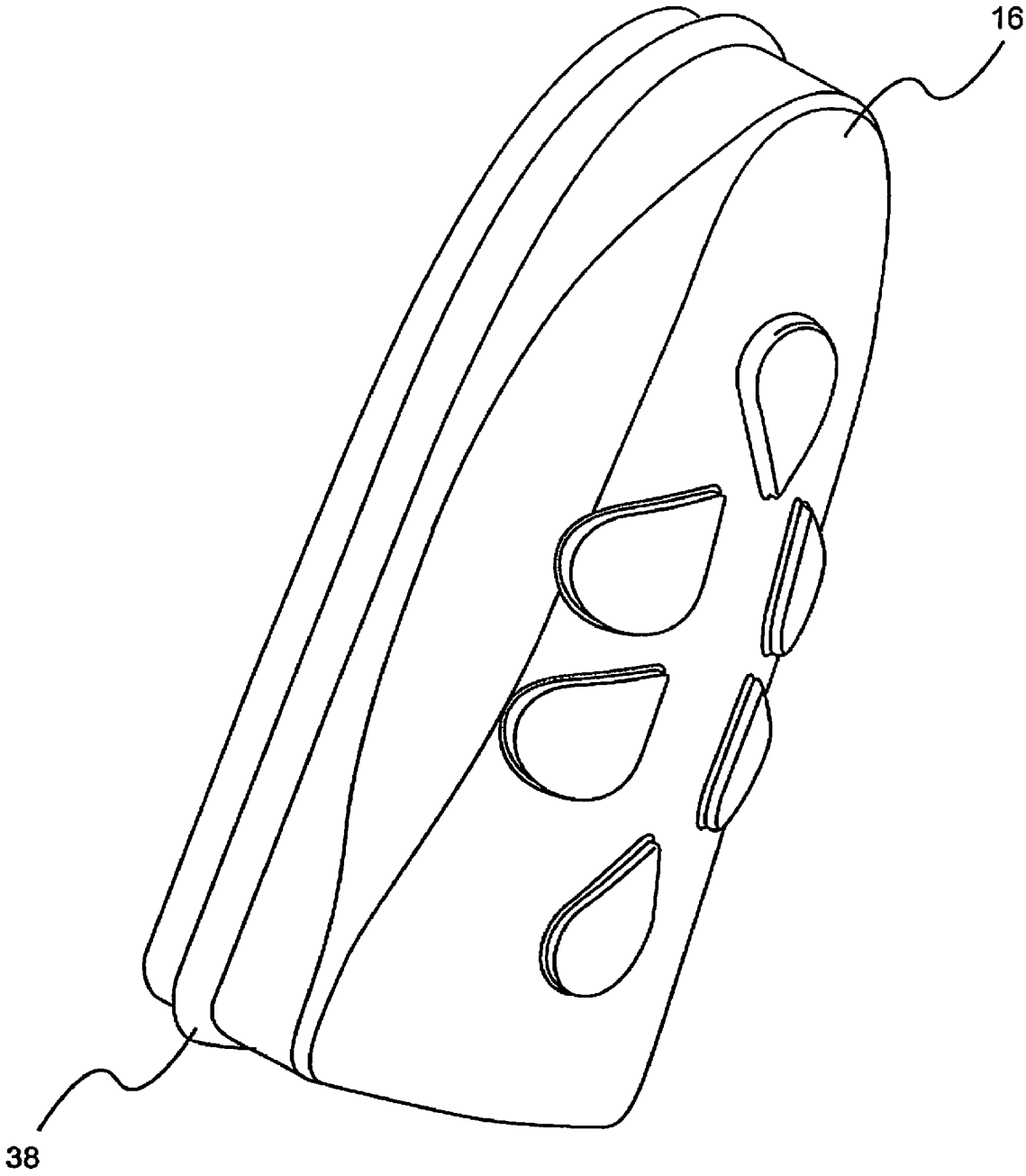
FIG. 6 is a perspective view of the flexible compartment cover.

FIG. 6 shows a view of the flexible compartment cover 16. This view shows a sealing ridge 38 which would interfit with a corresponding sealing ridge built into the side of the interior space 26 in the head 12 of the brush. If the sealing ridge is permanently attached to the head during manufacture the device could include a sonic welded seam between the sealing ridge 38 and the interior space 26 of the head 12. If not bonded permanently by sonic welding or other bonding means, the flexible compartment cover 16 can optionally be removable so that the cleaning product may be replaced for further use.

Figure 7:
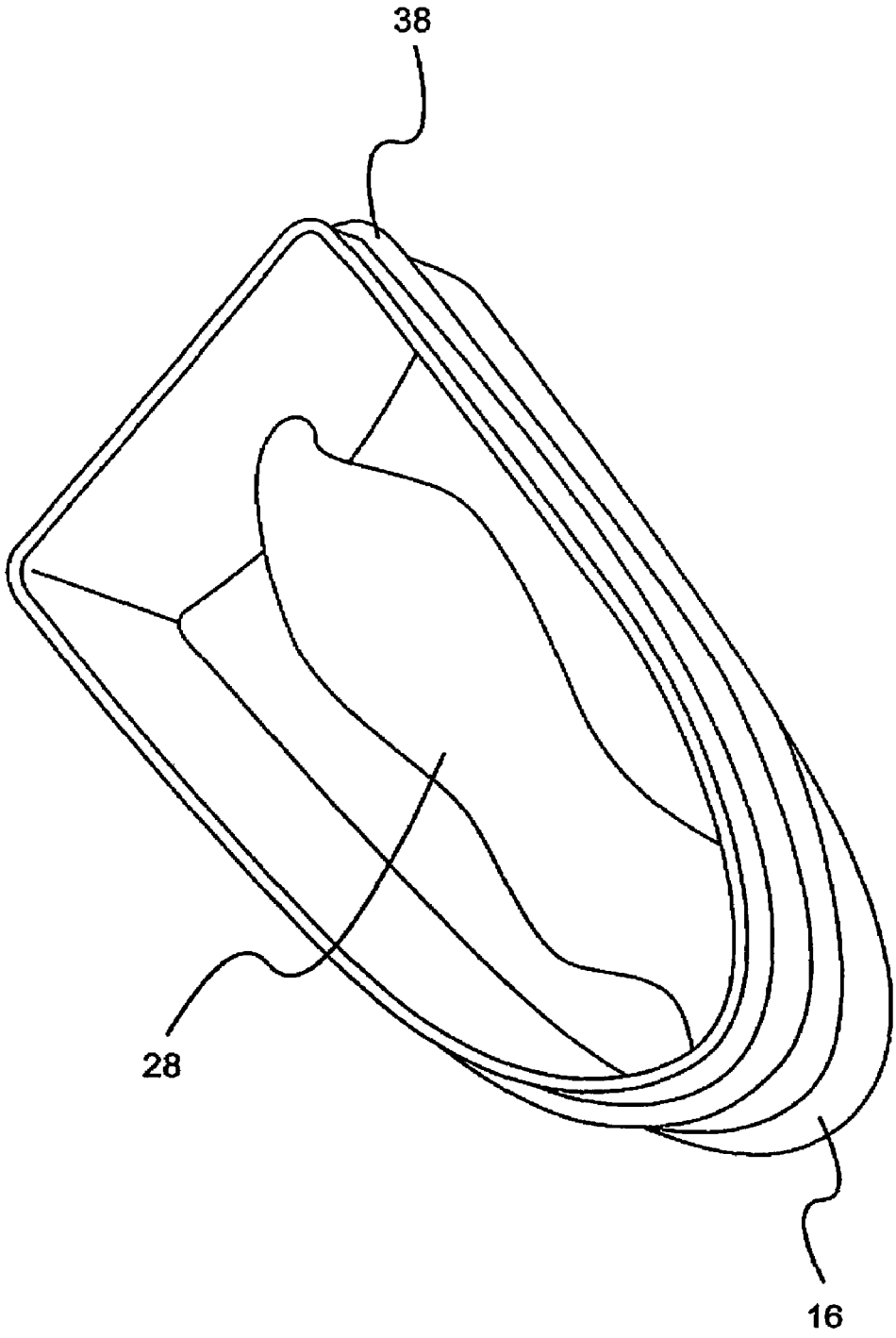
FIG. 7 is a perspective view of the inside of the flexible compartment cover with a quantity of cleaning product deposited in the flexible compartment cover.

FIG. 7 shows a sealing compartment 16 with a quantity of cleaning product 28 enclosed within it.

In the following description and in the figures, like elements are identified with like reference numerals. The use of "or" indicates a non-exclusive alternative without limitation unless otherwise noted. The use of "including" means "including, but not limited to," unless otherwise noted.

While there is shown and described the present preferred embodiment of the invention, it is to be distinctly understood that this invention is not limited thereto, but may be variously embodied to practice within the scope of the following claims. From the foregoing description, it will be apparent that various changes may be made without departing from the spirit and scope of the invention as defined by the following claims.

I claim:

1. A cleaning brush comprising:

a handle with a spoon shaped portion having a concave front surface and a convex back surface, with said spoon shaped portion of said handle and a tapered portion of said handle, said handle having a longitudinal axis, with said spoon shaped portion of said handle having a width approximately double a width of a head and a length approximately 1.5 times a length of said head, and with said tapered portion of said handle having a length approximately equal in length to said head;

said head extending from said handle and having a front surface and a back surface, with said head defining a cavity for containing a quantity of cleaning product;

a plurality of bristles having bases connected to the head on the front surface, said bristles having bristle tips, said bristles extending generally perpendicularly out from the front surface of the head;

a flexible compartment cover attached to said head on said back surface of said head over said cavity in said head, with said flexible compartment cover configured to contain and seal from the environment a cleaning product between said flexible compartment cover and said head back surface; and with said head defining at least one hole extending from the front surface among said bristles to said cavity, with said cavity configured for receiving a quantity of cleaning product;

wherein said flexible compartment cover is adapted to flex concavely inward to compress the cleaning product and cause said cleaning product to be forced through said at least one hole in said head, for use of said cleaning product when said bristles are used to clean an object.

2. The cleaning brush of claim 1 in which said flexible compartment cover is removably attached to said head, and with said flexible compartment being removable from said head for addition of said cleaning product.

3. A cleaning brush comprising:

a handle with a generally spoon shaped portion having a concave front surface and a convex back surface for gripping said brush, said handle having a tapered portion attached to a head and to said spoon shaped portion, said handle having a longitudinal axis, spoon shaped portion of said handle having a width approximately double a width of a head and a length approximately 1.5 times a length of said head, and with said tapered portion of said handle having a length approximately equal in length to said head;

said head attached to and extending from said handle and having a front surface and a back surface, with said head comprising an interior cavity defined in said back surface, with said interior cavity open on said back surface, said cavity for receiving a quantity of cleaning paste, and a finger ridge attached to said tapered portion of said handle of said head; said finger ridge adjacent to said bristle bases between said head and said tapered portion of said handle, for assisting the user in squeezing said flexible compartment cover without touching the bristles with a finger, with said interior cavity further comprising a sealing ridge for receiving a corresponding sealing ridge on a flexible compartment cover;

a plurality of bristles having bases connected to the head on the front surface, said bristles having bristle tips, said bristles extending generally perpendicularly out from the front surface of the head;

said flexible compartment cover attached to said head on said back surface of said head and covering said interior cavity, with said flexible compartment cover configured to contain and seal from the environment a cleaning product within said interior cavity; and with said head defining a plurality of holes extending from the interior cavity to the front surface among said bristles attached to the front surface, wherein said flexible compartment cover is adapted to flex concavely inward to compress cleaning product and cause said cleaning product to be forced through said holes in said head, for use of said cleaning product when said bristles are used to clean an object.

4. The cleaning brush of claim 3 in which said finger ridge is a ridge approximately one fourth to the full height of the bristles.

5. The cleaning brush of claim 1 which further includes a sealing cap over said cleaning brush for sanitary isolation of said cleaning brush.

* * * * *

UNITED STATES PATENT AND TRADEMARK OFFICE

CERTIFICATE OF CORRECTION

PATENT NO. : 7,641,410 B2
APPLICATION NO. : 11/424652
DATED : January 5, 2010
INVENTOR(S) : Dale M. Frazell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 61 days.

Signed and Sealed this

Sixteenth Day of November, 2010

David J. Kappos

David J. Kappos
*Director of the United States Patent and Trademark Office*